United States Patent [19]

Gebhardt et al.

[11] Patent Number: 4,928,428

[45] Date of Patent: May 29, 1990

[54] LEVER-ACTIVATED LOCKING BAR BRACE FOR A WINDOW OR A DOOR

[75] Inventors: Axel Gebhardt; Bernd Diekmann, both of Bielefeld; Rüdiger Schmidt, Lage, all of Fed. Rep. of Germany

[73] Assignee: Schuco Heinz Schurmann GmbH & Co., Fed. Rep. of Germany

[21] Appl. No.: 943,665

[22] Filed: Dec. 18, 1986

[30] Foreign Application Priority Data

Dec. 23, 1985 [DE] Fed. Rep. of Germany ..... 3545861525

[51] Int. Cl.[5] ..... E05D 15/52

[52] U.S. Cl. ..... 49/192

[58] Field of Search ..... 49/192

[56] References Cited

U.S. PATENT DOCUMENTS 4,637,165 1/1987 Schneider ..... 49/192

4,679,352 7/1987 Bates ..... 49/192

FOREIGN PATENT DOCUMENTS 2175631 12/1986 United Kingdom ..... 49/192

*Primary Examiner*—Joseph Falk

*Assistant Examiner*—Gerald A. Anderson

[57] ABSTRACT

A housing outlet comprises an inner closure frame provided with a C-shaped receiving groove and having a plurality of sections and a locking bar assembly having a single handle and a plurality of locking bars which are slidably supported in the receiving groove. The locking bars have a U-shaped cross section with two legs having side grooves extending over the full length of the legs and limited by a lower web having a thickness of S1 and an upper web having a thickness of S2. The receiving groove has a height $H_1$ which is greater than the height $H_2$ of the locking bar by the thickness S1 of the lower web. The receiving groove and the locking bar have a cross-section which is the same in all sections of the closure frame. The receiving groove has an inwardly extending edge strip, which has a height H3 smaller than the height N of the side grooves.

20 Claims, 12 Drawing Sheets

2
48
6
44
46
VIII
50
45
VIII 9
2
6
13
12
27
17
25
29
IX

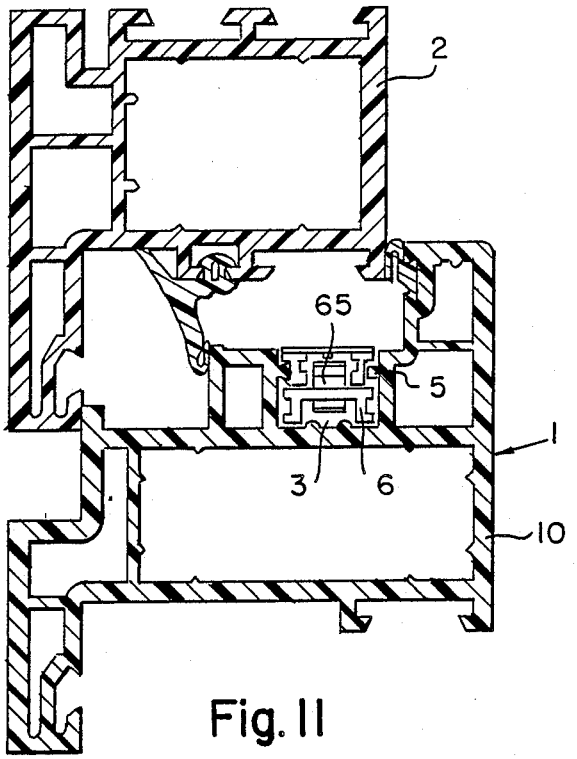
Fig. 11
Fig. 19
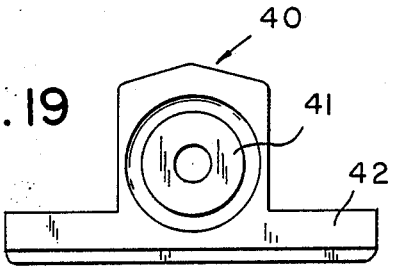
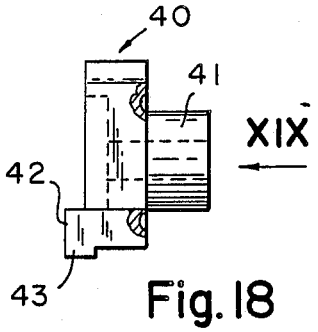
Fig. 18

Fig. 16
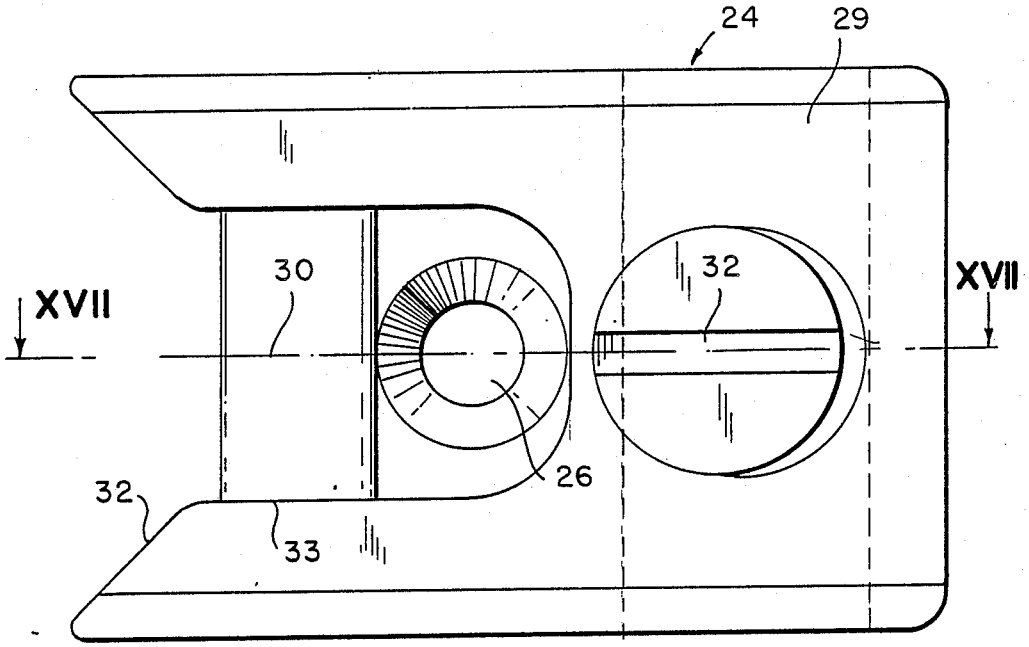
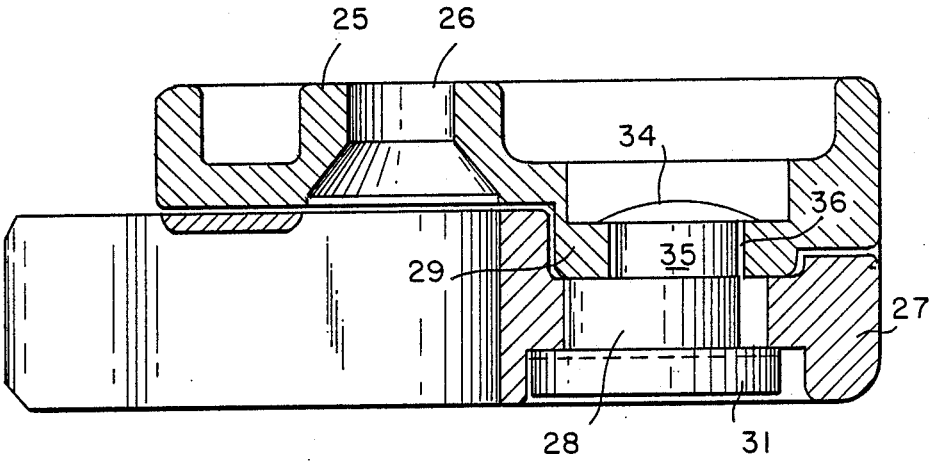
Fig. 17

LEVER-ACTIVATED LOCKING BAR BRACE FOR A WINDOW OR A DOOR

BACKGROUND OF THE INVENTION

The present invention relates to a locking bar assembly for a window or door which preferably has a synthetic plastic frame. The assembly includes a single manually operable lever in the form of a handle and locking bars slidably supported in C-shaped receiving grooves of the frame.

BRIEF DESCRIPTION OF THE PRIOR ART

Windows and doors of the above-mentioned general type are known in the art. One such window or door is disclosed in the European Pat. No. 0 056 484 which has a sash provided with a reverse rail brace. The reverse rail brace has prefabricated structural units, such as reverse metal sheets, which support the locking bars provided with arresting pins in a longitudinally displaceable manner. The arresting pins extend through the elongated openings of the reverse metal sheet, and perform covering and mounting functions. The handle-side reverse rail unit is provided with a transmission or gearing, which is actuated by a manual lever.

The prior reverse rail units have coupling devices which are form-locking at their one end, and serve for connecting these units to other brace units, such as deviators. The coupling devices can be made in lengths of, for example 100 mm in certain regions, so as to be adapted to different window sizes. This adaptability is, however, not sufficient for a great number of different window sizes, and therefore an extensive inventory of reverse rail units is required in plants manufacturing windows and doors.

The reverse rails and the locking bars in the reverse rail units are formed as sheet metal parts, for obtaining a minimum possible height of the structure. All forces which occur in the locking elements must be taken up by the locking bar, which transmits these loads to the reverse rail. High surface pressures occur in the contact region, which in turn results in an undue tightness of the brace.

The reverse rails are generally mounted by screws or other mounting elements onto the synthetic plastic profile of the frame of the closure. These mounting elements must take up the loads. The synthetic plastic material is, however, characterized by a low transmittable surface pressure, so that in the known construction there occurs a risk of overloading the mounting elements. In addition, lubrication is required in the reverse rail braces, because of the steel-to-steel friction which occurs. Post-lubrication of such reverse rail braces in an assembled condition is difficult, however, since the surfaces to be provided with the lubricating medium are located in a region which is covered by the reverse rails and is not accessible from outside. In the known window and door systems made of aluminum, brace receiving grooves are provided to fully guide the locking bars, and the locking bars fill the receiving grooves. Locking rollers are introduced into the U-shaped or C-shaped locking bars, so that the locking forces which act upon the locking rollers are also transmitted via the locking bars onto the frame profile. In addition to tolerance which are taken into consideration such as transmission play, lubrication of sliding surfaces is also required for unobjectionable operation of the locking bars.

A further disadvantage of the known locking bar braces takes place in an upper horizontal region of the closure of the pivoting and tilting design, in which region the adjusting device is provided. The adjusting device is anchored for economy of space in the brace receiving groove of the upper strut or section of the closure frame. Therefore a special locking rod is required for the longitudinal locking band of the adjusting device. Guiding of this adjusting device is carried out by a housing which is also provided with a pivot point for the tongue or scissor-type arms for the closure frame.

SUMMARY OF THE INVENTION

Accordingly, it is an object of the present invention to provide a window or a door of the above-mentioned general type, which avoids the disadvantages of the prior art.

More particularly, it is an object of the present invention to provide a closure such as a window or a door, which is designated so that a locking bar unit can be used in all sections of the closure frame, and so that the associated different brace parts can be connected or combined with these locking bars in order for the closing and locking forces to be extended directly in the closure frame profile.

In keeping with these objects and with others which will become apparent hereinafter, one feature of the present invention resides in a window or door frame containing a groove for a locking bar in which the locking bar has a U-shaped cross-section and a pair of side legs, each side leg having a side groove extending through the entire length of the bar. Each side groove is limited by a lower web with a thickness S1 and an upper web with a thickness S2 and has a height N. The height $H_1$ of the receiving groove is greater than the height $H_2$ of the locking bar by the thickness S1. The receiving groove in the frame has an inwardly extending edge strip with a height $H_3$ less than the height N of the side grooves.

When the locking bar brace of a window or a door is designed in accordance with the present invention, the reverse rails, mounting elements for fixing the rails to the struts of the closure frame, and means for slidably guiding the locking bars are dispensed with. The U-shaped locking bar is slidably supported either on the bottom of the receiving groove of the respective strut of the closure frame, or on the edge strip of the receiving groove. As for the other parts which must be connected with the locking bars, the connection is performed by a simple plug connection with the insertion of a pin of one brace part into an opening of the locking bar. These brace parts are additionally guided onto a wall or onto the edge strip of the receiving groove. A force transmission from the brace parts to the closure frame is performed through these guiding surfaces. The locking bars and the brace parts can be composed of synthetic plastic material, so that in operation no lubrication of these parts is needed.

BRIEF DESCRIPTION OF THE DRAWINGS

The novel features of the present invention are set forth in particular in the appended claims. The invention itself, however, will be best understood from the following description of preferred embodiments, which is accompanied by the following drawing, in which:

FIG. 11 is a sectional view of the handle-side corner taken along the line XI—XI in FIG. 10;

FIG. 16 is a plan view.of a closing piece which is fixed on an outer frame and associated with the locking piece;

FIG. 17 is a sectional view of the closing piece taken along the line XVII—XVII in FIG. 16;

FIG. 18 is a side view of a driver or entraining element which can be coupled with a locking bar and actuated by a handle;

FIG. 19 is a view of the driver in a direction of the arrow XIX in FIG. 18;

DETAILED DESCRIPTION

Figure 1:
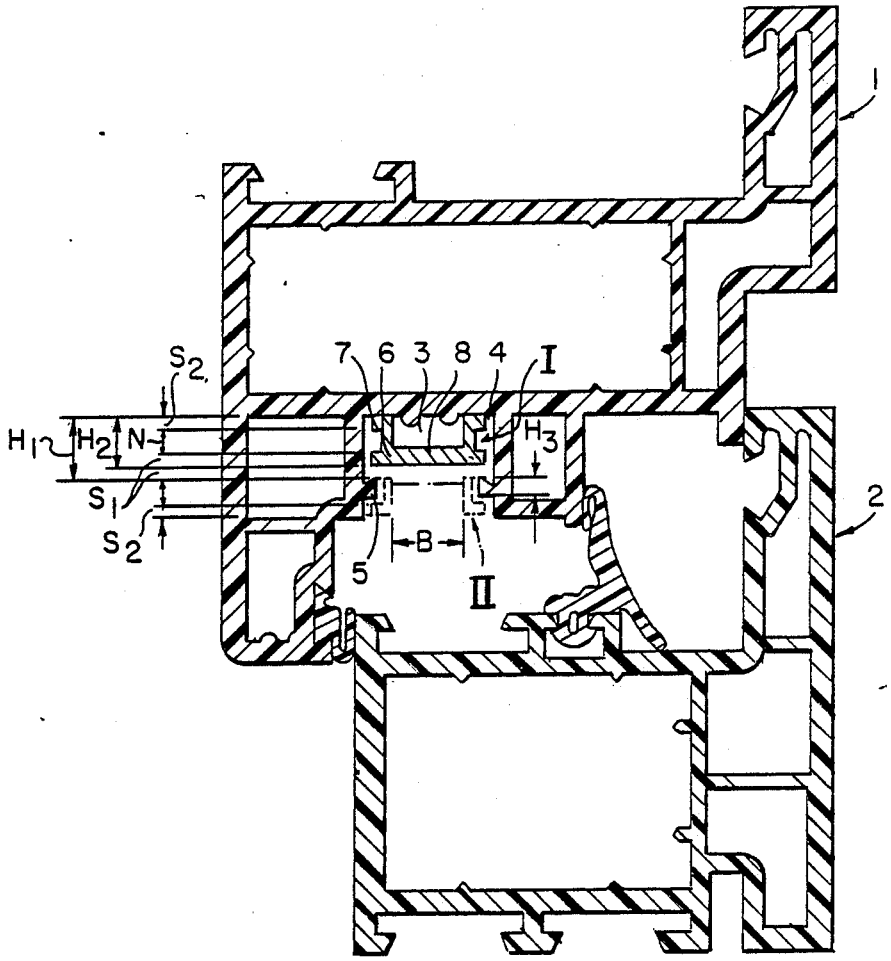
FIG. 1 is a sectional view of the struts of the inner and outer frames of a synthetic plastic window.

Referring to FIG. 1, there are shown two frames, an inner closure frame 1 such as is arranged about the outer-perimeter of a closure such as a window or door, and an outer opening frame 2 arranged about the inner perimeter of an opening in a wall. Each frame has a generally rectangular configuration and is formed of hollow synthetic plastic struts or sections which are leveled and connected at the corners thereof. The inner frame 1 includes a continuous C-shaped groove 3 for receiving a locking bar or other brace. The groove 3 has the same cross-section in each section of the frame and has an inner height $H_1$ between the groove bottom surface 4 and an inwardly extending edge strip 5.

A locking bar 6 is arranged within the groove 3 and has a U-shaped cross-section as shown in FIG. 1. The bar includes a pair of legs 7 spaced by a distance B each leg containing an external side groove extending along the length of the bar and having an inner height N. Each side groove is defined between a lower web 7*a* having a thickness $S_1$ and an upper web 7*b* having a thickness $S_2$. The inner height $H_1$ of the groove 3 is greater than the height $H_2$ of the locking bar 6 by the web thickness $S_2$. The edge strips 5 of the groove 3 have a height $H_3$ smaller than the inner height of the side grooves.

The design and size of the locking bar 6 and of the groove 3 enable the locking bar to be slidably supported within the groove in two operative positions. The first operative position is identified in FIG. 1 as I. In the first operative position I, the locking bar 6 assumes the location shown in solid lines. It is supported with its legs 7 on the bottom surface 4 of the groove 3, and is slidably guided relative to the bottom surface. The bottom 8 of the locking bar faces the opening of the receiving groove 3 which is limited by the edge strips 5.

The second operative position of the locking bar 6 is identified as II. In this operative position, shown in FIG. 1 in dash-dot lines, the edge strips 5 engage the side grooves of the locking bar 6. The locking bar is slidably supported on the edge strip, and the bottom 8 of the locking bar lies inside the receiving groove 3.

Figure 6:
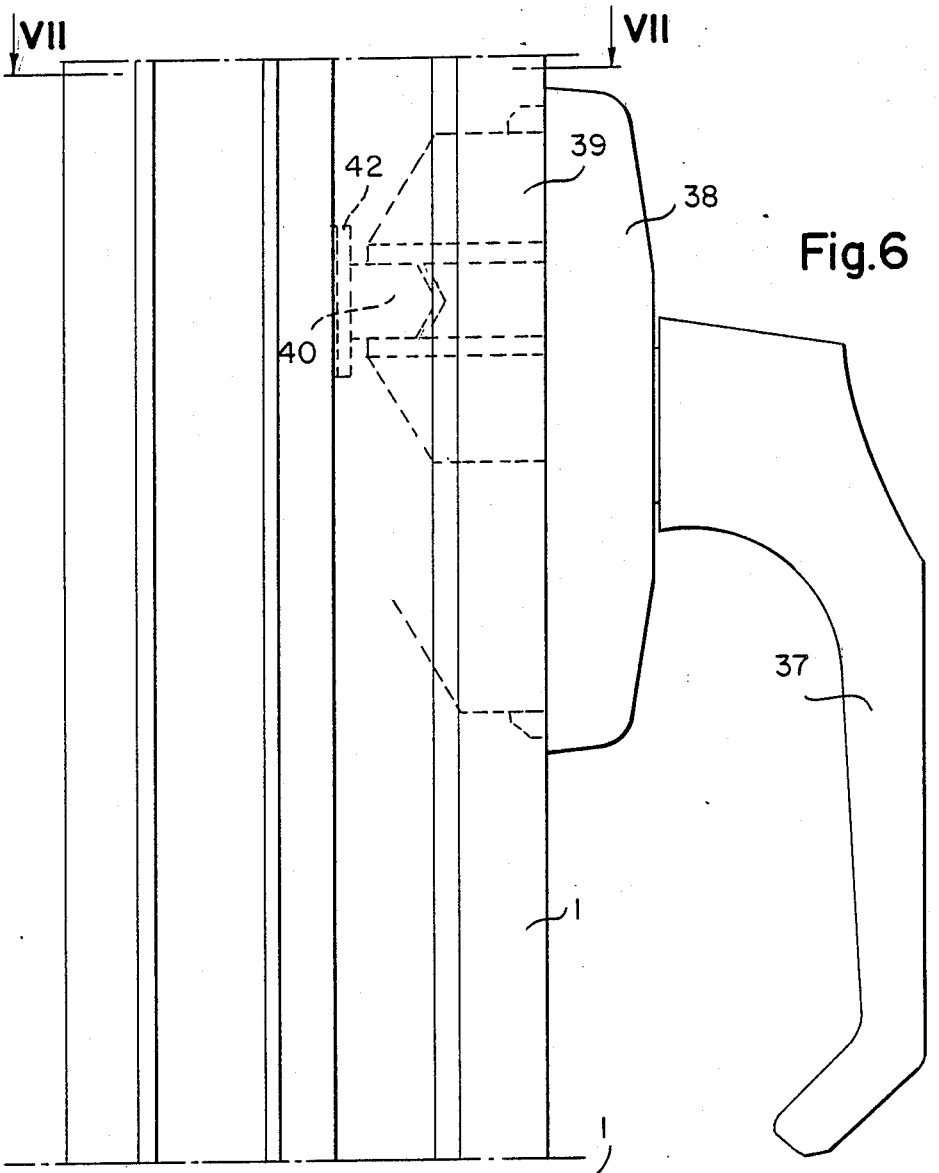
FIG. 6 is a plan view showing a handle mounted on a closure frame section.

The inner frame 1 is adapted to pivot or tilt relative to the outer frame 2, both frames comprising horizontal and vertical sections. To accommodate the pivoting and tilting shown in the drawing, the locking bars 6 in the grooves contained in the horizontal sections 9 and 10 of the inner frame 1 and the hinged vertical section 11 are arranged in the first operative position I wherein the side legs 7 of the bar are supported on the bottom surface 4 of the groove 3 and are slidably guided relative to this surface. The locking bar 6 assumes the second operative position II in the groove contained in the vertical section of the inner frame 1 with which a handle (FIGS. 6 and 7) is connected. In the second position, the locking bar is slidably supported on the edge strip 5 of the groove 3.

Figure 9:
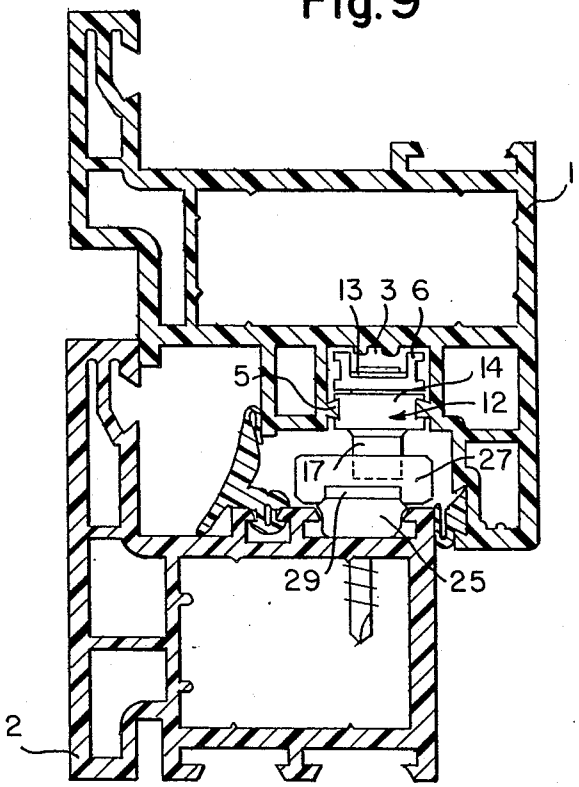
FIG. 9 is an end view of the locking region of a lower horizontal section of a pivoting and tilting window in a direction of the arrow IX in FIG. 5.
Figure 12:
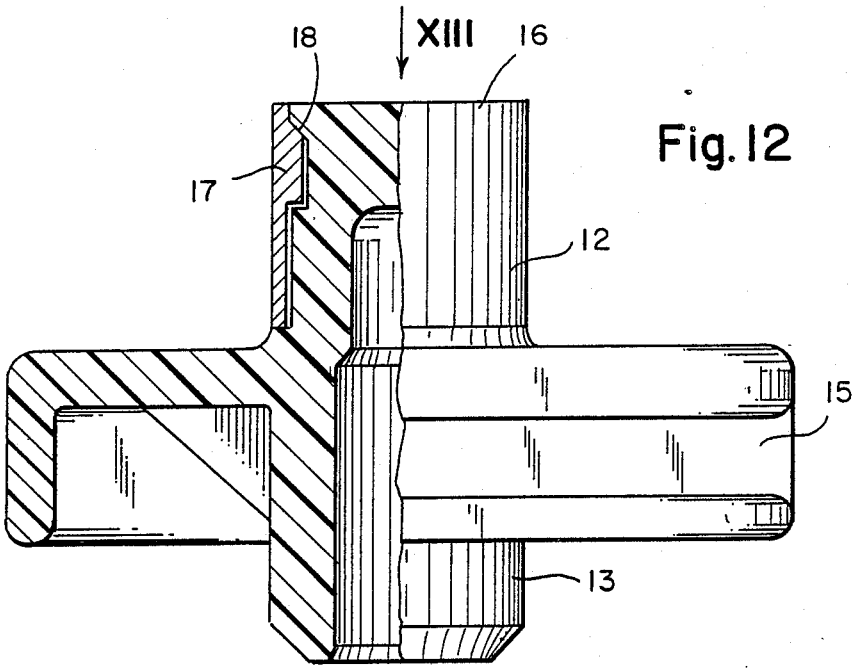
FIG. 12 is a partial sectional view of a locking piece.
Figure 13:
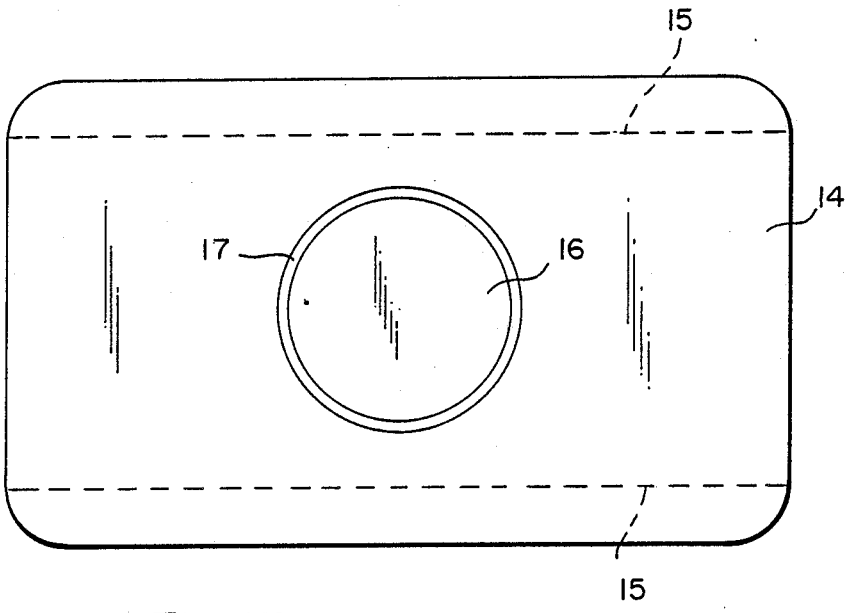
FIG. 13 is a top view of the locking piece taken in the direction of the arrow XIII in FIG. 12.

Locking pieces are provided for the locking bar 6 and for the groove 3, respectively. Referring to FIGS. 12 and 13, there is shown a first locking piece 12 including a hollow anchoring pin 13 which is adapted for insertion into an opening of the locking bar 6. The first locking piece 12 also includes a plate 14 having grooves 15 on its longitudinal sides for receiving the edge strips 5 of the groove 3 as shown in FIG. 9. A bearing pin 16 is provided on the locking piece 12 opposite the pin 13 and a metal roller 17 is rotatably supported on the bearing pin. The roller 17 has a hollow bore 18. The locking piece 12, which is formed of synthetic plastic material, is heated and a portion of the pin 16 flows into the bore 18. After cooling and shrinking of the plastic material, a limited amount of play is provided between the roller and pin for rotation of the roller. As shown in FIG. 12, the bearing pin 16 has a stepped cylindrical contour and the inner configuration of the roller 17 conforms thereto.

Figure 10:
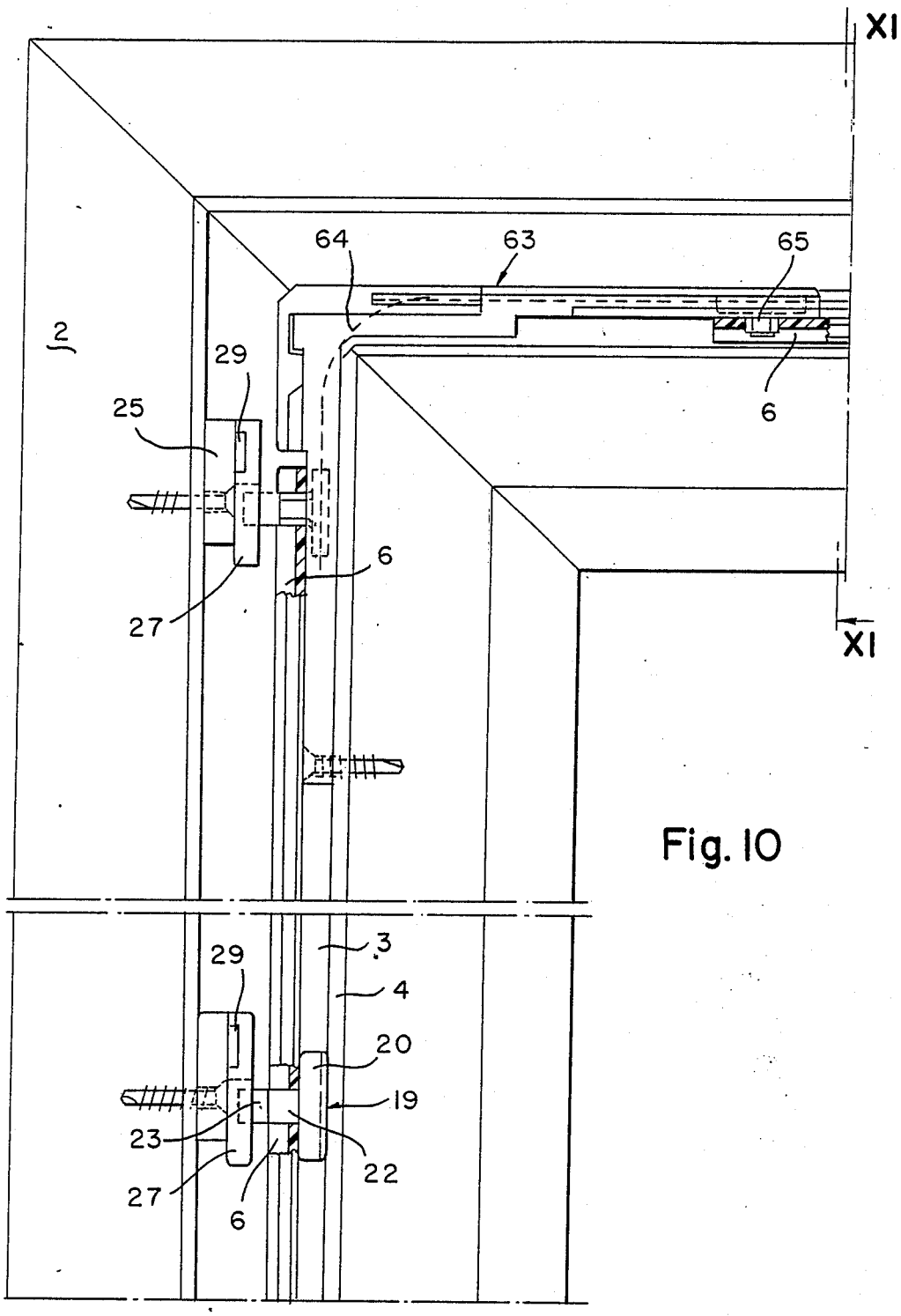
FIG. 10 is a partial sectional view of an upper handle-side corner of a pivoting and tilting window.
Figure 14:
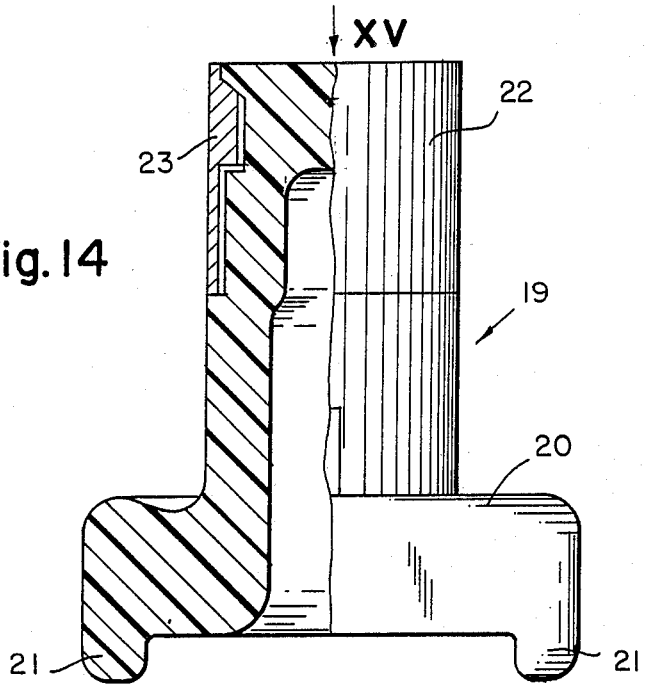
FIG. 14 is a partial sectional view showing another embodiment of a locking piece.
Figure 15:
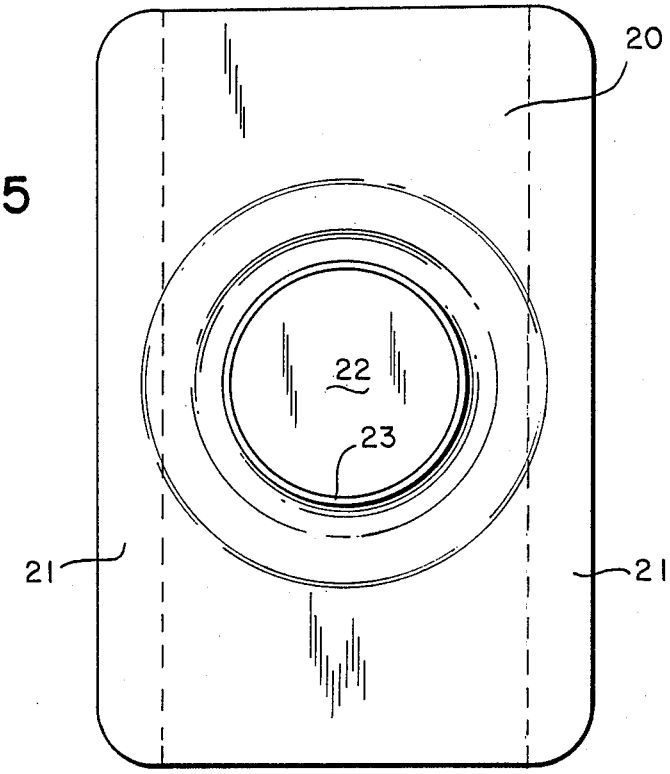
FIG. 15 is a view of the second locking piece in a direction of the arrow XV in FIG. 14.
Figure 20:
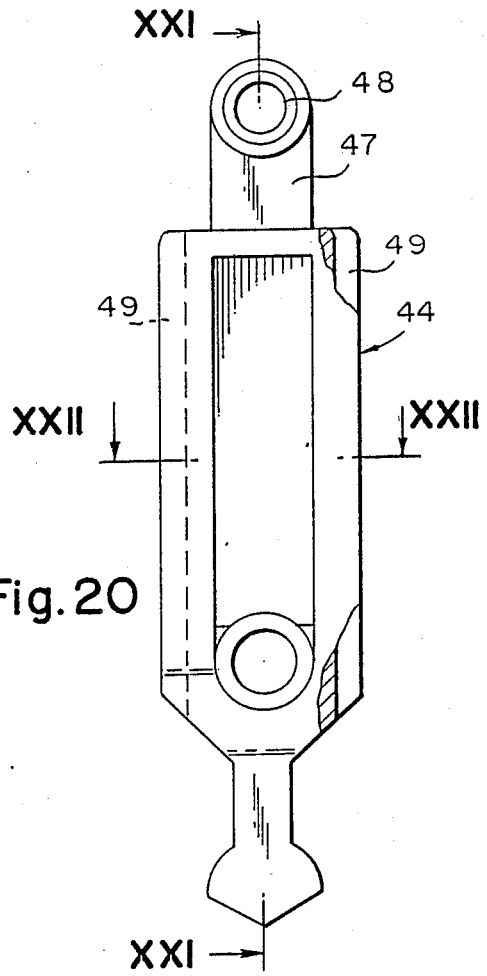
FIG. 20 is a plan view of a finger lock which can be coupled with a locking bar.
Figure 21:
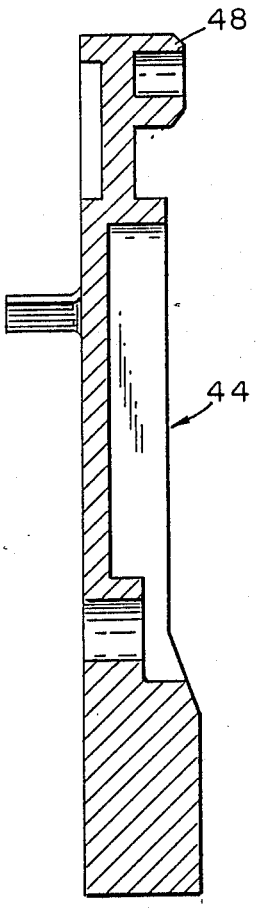
FIG. 21 is a sectional view of the finger lock taken along the line XXI—XXI in FIG. 20.
Figure 22:
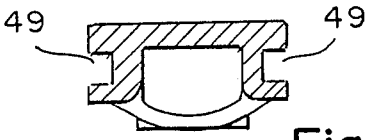
FIG. 22 is a sectional view of the finger lock taken along the line XXII—XXII in FIG. 20.

The second locking piece 19 is shown in FIGS. 14 and 15 and includes a rectangular plate 20 provided with a sliding runner 21 in the region of its lower longitudinal edges slidably supported on the bottom surface 4 of the groove 3. A bearing pin 22 extends from the plate 20 at the side opposite the runner 21 and is provided at its upper end with a metal roller 23 in the same manner as the pin 16 has a roller 17. As shown in FIG. 10, the plate 20 of the second locking piece 19 is inserted into the groove 3 of the vertical section of the frame 1 with which the handle is connected. The bearing pin 22 is inserted through an opening into the bottom of the locking bar 6, which assumes the first operative position I. The bearing pin 22 extends through the inner space of the locking bar 6 defined between the legs 7 and having a width B. Preferably, the bearing pin 22 has a diameter corresponding with the width B of the bar space to insure that during mounting of the locking bar 6 in the second operative position II, the bearing pin 22 is held by the locking force occurring transversely to the locking bar along the full height $H_2$ and supported in this position.

A locking bracket for the locking pieces 12 and 19 is shown in FIGS. 16 and 17. The bracket 24 is mounted on outer frame 2 and is provided with a mounting socket 25 which contains a through-opening 26 for a counter-sunk screw which is threaded into the opening frame. A locking carriage 27 is arranged on the mounting socket, and is movable along a carriage guide 29 by means of an eccentric 28. The eccentric 28 is provided with a head plate 31, which has a slot 32 for receiving an actuating tool such as a screwdriver. The locking carriage 27 is fork-shaped for receiving the metal rollers 17 or 23 of the locking pieces 12 or 19. It is also provided with locking surfaces 32 and 33. The location of these locking surfaces can be adjusted by the eccentric. The non-releasable connection between the mounting socket 25 and the locking carriage 27 is attained by a rivet head 34 of a cylindrical pin 35 which is integrally formed with the eccentric 28 and is rotatably supported in an opening 36 of the mounting socket 25.

Figure 7:
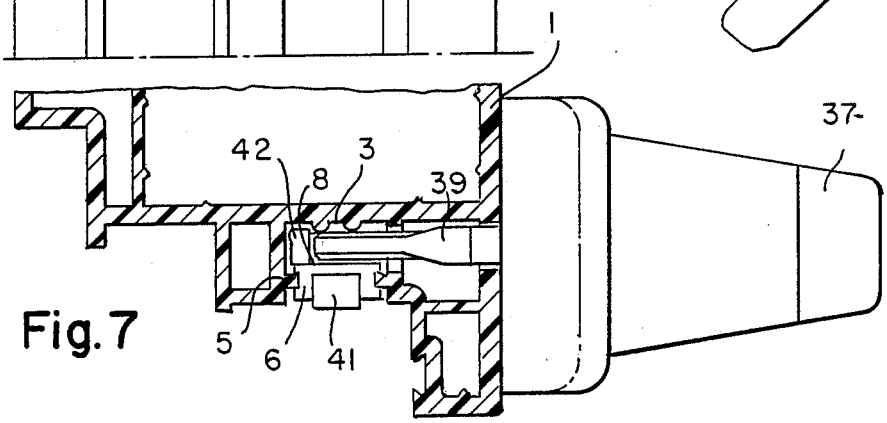
FIG. 7 is a sectional view of the section taken along line VII—VII in FIG. 6.

Referring now to FIG. 7, the handle for mounting the locking bar is shown. The handle 37 is rotatably supported in a housing 38 which is secured to the inner frame 1. An adjustable slider 39 is actuated by the handle 37. The slider 39 extends through a recess in the inner frame to the receiving groove 3 and inter-engages there with a driver 40 in a form-locking manner. The driver 40 is coupled with the locking bar 6, which is slidably supported on the edge strip 5 of the receiving groove 3.

The details of the design of the driver 40 are shown in FIGS. 18 and 19. The driver 40 has a side pin 41 which is inserted into an opening in the bottom 8 of the locking bar 6. This plug connection provides for the coupling between the adjustable slider 39 and the locking bar 6. The driver 40 has a sliding piece 42, which is supported on a side wall of the groove. The sliding piece 42 has a rectangular contour, and can be provided with a sliding runner 43 abutting against the bottom wall of the receiving groove 3. The driver 40 with its pin 41 and the sliding piece 42, as well as the runner 43, are preferably formed as one piece of synthetic plastic material.

Figure 4:
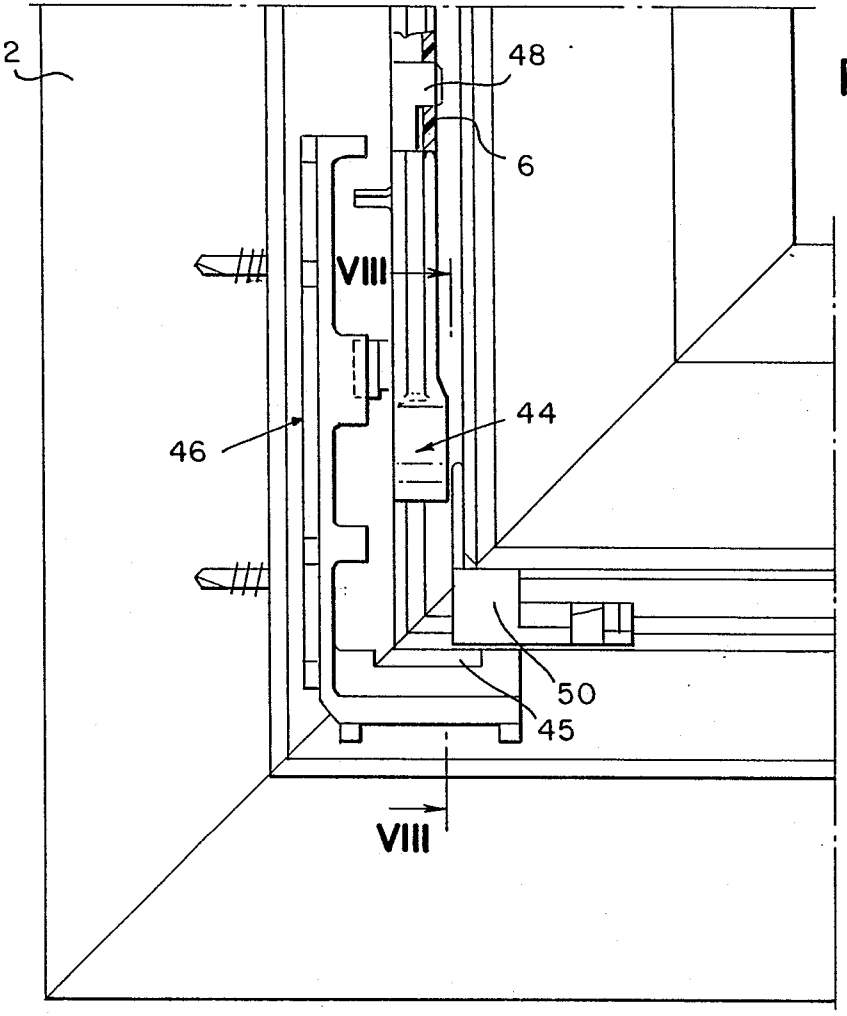
FIG. 4 is a partial sectional view of a lower handle-side corner of the pivoting and tilting window.
Figure 5:
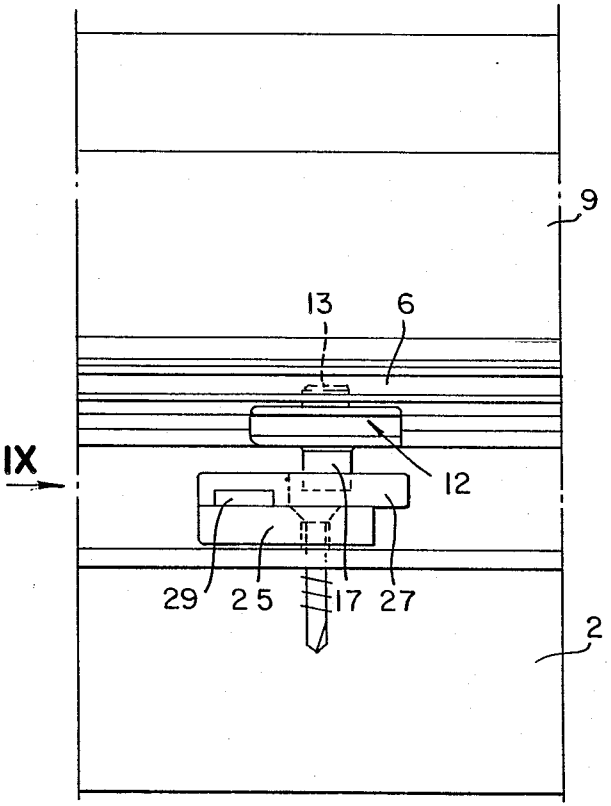
FIG. 5 is a partial plan view of a lower horizontal section of a pivoting and tilting window with a locking region.

As best shown in FIG. 4, a finger lock 44 is mounted on the lower end of the locking bar provided on the strut with which the handle is connected. The finger lock 44 engages in an angular bearing part 46 mounted on the outer frame 2, in the tilted position of the closure. As shown in FIGS. 4 and 20–22, a mounting end 47 of the finger lock engages in the inner groove of the locking bar 6. Its width corresponds with the spacing B of the inner groove of the locking bar. The mounting end has an anchoring pin 48, which extends into an opening in the bottom of the locking bar. The central part of the finger lock 44 is provided with side grooves 49 which are in alignment with the side grooves of the locking bar 6 so that the edge strips 5 of the receiving groove 3 engage in these side grooves 49. In FIG. 4, the finger lock 44 is shown in the closed position of the closure.

Figure 8:
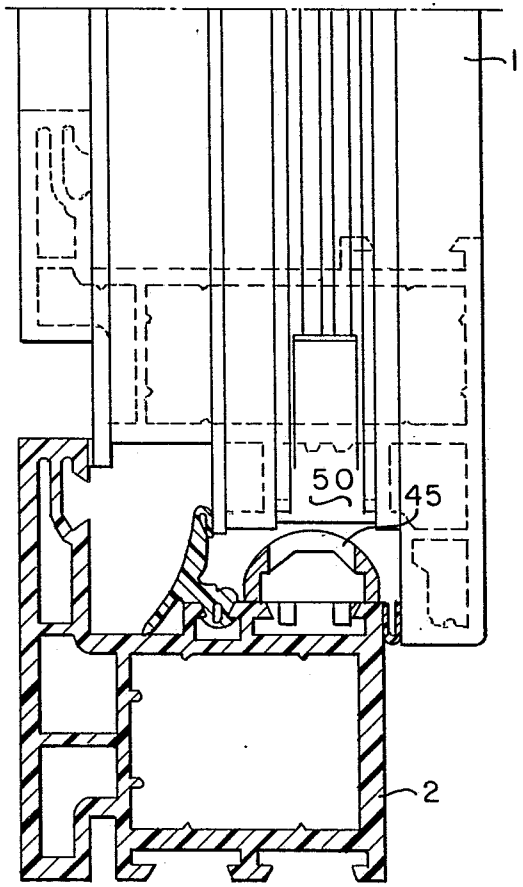
FIG. 8 is a sectional view of the window taken along the line VIII—VIII in FIG. 4.

An angular supporting part 50 of synthetic plastic material is provided on the handle-side lower end of the inner frame as shown in FIGS. 4 and 8. The supporting part 50 is supported on the lower horizontal leg of the bearing part 46, which is fixed to the outer frame, during the tilting movement of the inner closure frame.

Figure 2:
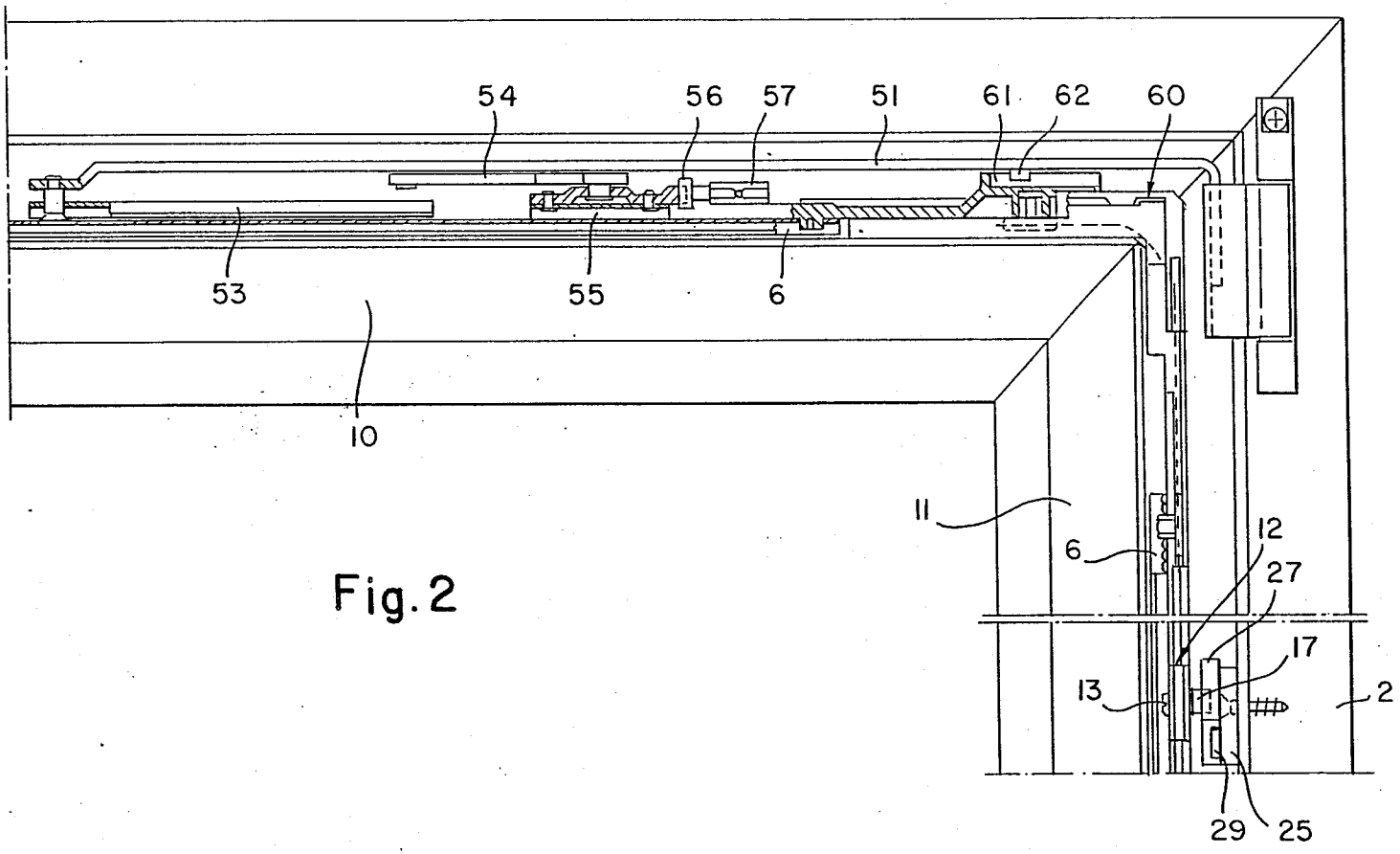
FIG. 2 is a partial sectional view of an upper hinge-side corner region of a pivoting and tilting window.
Figure 3:
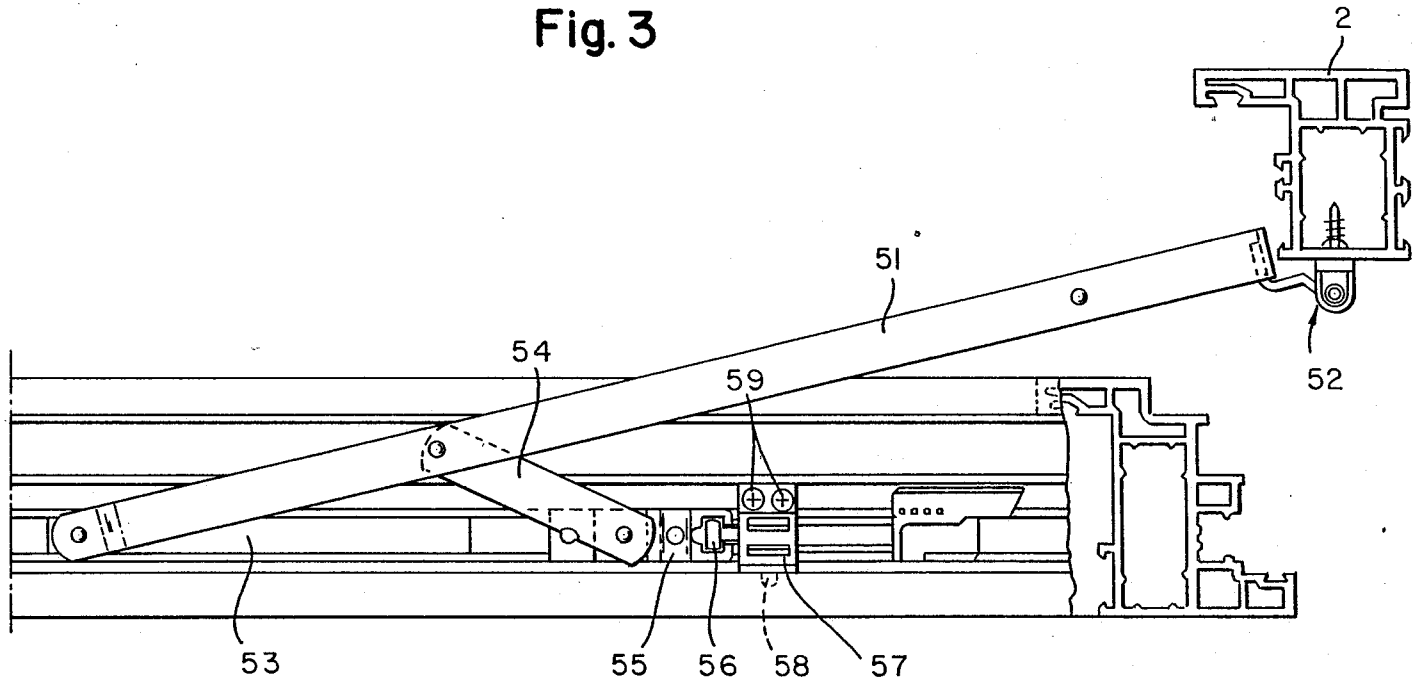
FIG. 3 is a plan view corresponding to FIG. 2, with a tilted closure.

FIGS. 2 and 3 show an adjusting device of a pivoting and tilting window. This device has a tongue or scissor-type arm 51, which is articulately connected with the outer frame by means of a pivot bearing 52 at its side facing the outer frame. Its other end is pivotally connected with a slider 53, which is slidably supported in the region of the edge strip of the receiving groove of the upper horizontal section 10 of the inner frame 1. The adjusting device further has an additional link 54, which is connected with a slider 55. The slider 55 is also slidably supported on the edge strip 5 of the receiving groove of the upper horizontal section of the inner frame, and can be displaced by an adjusting screw 56 relative to a bridge 57, which is fixed on the section 10 of the inner frame. The bridge 57 is provided with a projection 58 which is inserted into a recess of the upper section of the inner frame. The fixation of the bridge is performed by screws 59.

Since the sliders 53 and 55 are displaceably supported in the region of the edge strip 5 of the receiving groove 3 of the upper horizontal section of the inner frame, the locking bar 6 in the operative position I can be arranged under this slider and coupled with a locking piece 61 at the side facing the upper hinge-side corner rerouting device or deviator 60. The locking piece 61 extends to the region of the upper hinge-side corner deviator 60 and engages a pin 62 in the pivoted and closed position of the inner frame. The pin 62 is mounted on the tongue arm 51.

The locking bars can be composed of a fiberglass-reinforced plastic material.

The locking bar arranged in the receiving groove 3 of the upper horizontal section 10 of the inner frame is coupled with a spring band 64 of the corner deflector at an end which faces the handle-side upper corner deflector 63. It is coupled by a pin 65 which extends through an opening in the bottom of the locking bar 6.

The invention is not limited to the details shown, since various modifications and structural changes are possible without departing in any way from the spirit of the present invention.

What is claimed is:

1. A housing outlet, such as a window or a door, comprising (a) an inner closure frame provided with a C-shaped receiving groove and having a plurality of sections including lower and upper horizontal sections and a hinge-side vertical wing, said receiving groove having a bottom wall;

(b) a locking bar brace including a handle and a plurality of locking bars slidably supported in said receiving groove, said locking bars each having a U-shaped cross-section with two side legs of a predetermined length, each of said side legs having a side groove extending over a full length of said legs, each of said side grooves being limited by a lower web having a thickness of $S_1$ and an upper web with a thickness $S_2$, said side grooves having a height N, said receiving groove having a height $H_1$ which is greater than a height $H_2$ of said locking bar by the thickness $S_1$ of said lower web, said receiving groove and said locking bar having a cross-section which is the same in all of said sections of said closure frame, and said receiving groove having an inwardly extending edge strip which has a height $H_3$ less than the height N of said side grooves, said locking bars being slidably supported with said legs on said bottom wall of said receiving groove in said lower and upper horizontal sections and being supported at a handle-side on said edge strip of said receiving groove in said hinge-side vertical wing;

(c) a plurality of locking pieces connected with said locking bars of said vertical hinge-side section and said lower horizontal section;

(d) anchoring pins connecting said locking pieces with said vertical and lower horizontal sections, said locking pieces being provided with rectangular plates having longitudinal sides with side grooves, said plates having a side opposite to said anchoring pins and being provided at said side with a bearing pin; and (e) a metal roller rotatably supported on said bearing pin.

2. A housing outlet as defined in claim 1, wherein said pins and said plates are formed as a one piece element of synthetic plastic material.

3. A housing outlet as defined in claim 1, wherein said metal roller is formed as a metal ring and has an outer end with a hollow bore accommodating an excessive material of said bearing pin.

4. A housing outlet as defined in claim 1, wherein said bearing pin has a stepped cylindrical outer contour, said metal roller having an inner contour which corresponds to said outer contour of said bearing pin.

5. A housing outlet as defined in claim 1, and further comprising an outer opening frame and an adjustable closing piece mounted on said opening frame, said metal roller of said locking piece cooperating with said closing piece.

6. A housing outlet as defined in claim 5, wherein said closing piece includes a mounting socket provided with a guide, a locking carriage provided with locking surfaces, and an eccentric arranged so that said locking carriage is movable along said guide of said mounting socket via said eccentric.

7. A housing outlet, such as a window or a door, comprising (a) an inner closure frame provided with a C-shaped receiving groove and having a plurality of sections; and (b) a locking bar brace including a handle and a plurality of locking bars slidably supported in said receiving groove, said locking bars each having a U-shaped cross-section with two side legs of a predetermined length, each of said side legs having a side groove extending over a full length of said legs, each of said side grooves being limited by a lower web having a thickness of $S_1$ and an upper web with a thickness $S_2$, said side grooves having a height N, said receiving groove having a height $H_1$ which is greater than a height $H_2$ of said locking bar by the thickness $S_1$ of said lower web, said receiving groove and said locking bar having a cross-section which is the same in all of said sections of said closure frame, and said receiving groove having an inwardly extending edge strip which has a height $H_3$ less than the height N of said side grooves, said locking bars including one locking bar which is actuatable by said handle, and further comprising at least one locking piece which is connected with said one locking bar, said receiving groove having a bottom wall, said locking piece having a rectangular plate which is slidably supported on said bottom wall of said receiving groove, said one locking bar having a bottom wall containing an opening, said plate being provided with a bearing pin having an end region, and a metal roller formed as a metal ring rotatably supported on said bearing pin in said end region.

8. A housing outlet as defined in claim 7, wherein said one locking bar has a predetermined inner size, said bearing pin having a diameter which corresponds to the inner size of said one locking bar.

9. A housing outlet as defined in claim 7, wherein said locking bars are composed of fiberglass-reinforced synthetic plastic material.

10. A housing outlet, such as a window or a door, comprising (a) an inner closure frame provided with a C-shaped receiving groove and having a plurality of sections;

(b) a locking bar brace including a handle and a plurality of locking bars slidably supported in said receiving groove, said locking bars each having a U-shaped cross-section with two side legs of a predetermined length, each of said side legs having a side groove extending over a full length of said legs, each of said side grooves being limited by a lower web having a thickness of $S_1$ and an upper web having a thickness $S_2$, said side grooves having a height N, said receiving groove having a height $H_1$ which is greater than a height $H_2$ of said locking bar by the thickness $S_1$ of said lower web, said receiving groove and said locking bar having a cross-section which is the same in all of said sections of said closure frame, and said receiving groove having an inwardly extending edge strip which has a height $H_3$ less than the height N of said grooves, said locking bars having a bottom wall containing an opening, said receiving groove having a groove wall, said handle having an adjusting slider which extends into said receiving groove of one of said sections; and (c) a driver which engages with said adjusting slider in a form-locking manner and has a side pin which engages in said opening of said bottom wall and a sliding piece supported on said groove wall.

11. A housing outlet as defined in claim 10, wherein said sliding piece has a rectangular contour and is provided with a runner abutting against said groove wall.

12. A housing outlet as defined in claim 11, wherein said driver with said pin, said sliding piece, and said runner are formed as a one piece element of synthetic plastic material.

13. A housing outlet, such as a window or a door, comprising (a) an inner closure frame provided with a C-shaped receiving groove and having a plurality of sections;

(b) a locking bar brace including a handle and a plurality of locking bars including a handle-side locking bar having a lower end, said locking bars being slidably supported in said receiving groove, said locking bars each having a U-shaped cross-section with two side legs of a predetermined length, each of said side legs having a side groove extending over a full length of said legs, each of said side grooves being limited by a lower web having a thickness of $S_1$ and an upper web with a thickness $S_2$, said side grooves having a height N, said receiving groove having a height $H_1$ which is greater than a height $H_2$ of said locking bar by the thickness $S_1$ of said lower web, said receiving groove and said locking bar having a cross-section which is the same in all of said sections of said closure frame, and said receiving groove having an inwardly extending edge strip which has a height $H_3$ less than the height N of said side grooves;

(c) a tilting bearing; and (d) a finger lock provided on said lower end of said handle-side locking bar and arranged for said handle-side tilting bearing.

14. A housing outlet as defined in claim 13, wherein said handle-side locking bar has an inner groove of a predetermined size and an opening, said finger lock having a mounting end which engages in said inner groove and having a width corresponding to the inner size of said inner groove, said finger lock including an anchoring pin which extends in said opening of said handle side locking bar.

15. A housing outlet as defined in claim 13, wherein said handle-side locking bar has side grooves, said finger lock having side grooves which are in alignment with said side grooves of said handle-side locking rod.

16. A housing outlet as defined in claim 15, wherein said closure frame has a lower handle-side corner, and further comprising an angular supporting part provided in said lower handle-side corner.

17. A housing outlet, such as a window or a door of a pivoting and tilting type, comprising (a) an inner closure frame provided with a C-shaped receiving groove and having a plurality of sections including an upper section;

(b) a locking bar brace including a handle and a plurality of locking bars slidably supported in said receiving groove, said locking bars each having a U-shaped cross-section with two side legs of a predetermined length, each of said side legs having a side groove extending over a full length of said legs, each or said side grooves being limited by a lower web having a thickness of $S_1$ and an upper web with a thickness $S_2$, said side grooves having a height N, said receiving groove having a height $H_1$ which is greater than a height $H_2$ of said locking bar by the thickness $S_1$ of said lower web, said receiving groove and said locking bar having a cross-section which is the same in all of said sections of said closure frame, and said receiving groove having an inwardly extending edge strip which has a height $H_3$ less than the height N of said side grooves;

(c) adjusting means including a tongue arm and an additional link, a first slider connecting said additional link, a second slider connecting said tongue arm, and a third slider connecting said additional link with said upper section, said sliders being movably mounted on said edge strips of said receiving groove of said upper section;

(d) a bridge which mounts said third slider connecting said additional link on said upper section; and (e) an adjusting screw arranged to adjust said third slider connecting said additional link relative to said bridge, said third slider connecting said additional link being arranged so that one of said locking bars is located under said sliders in said receiving groove.

18. A housing outlet as defined in claim 17, and further comprising an upper hinge-side corner deviator, said upper section having an end facing an upper corner bearing, and being provided at said end with a locking piece, said locking piece extending to the region of said upper hinge-side corner deviator.

19. A housing outlet as defined in claim 17, and further comprising an upper handle-side corner deviator, said locking bars including (a) one locking bar which is slidably guided in said receiving groove of said upper section and which has an end which faces said upper handle-side corner deviator;

(b) a spring band provided on said end of said one locking bar; and (c) a pin connecting said end of said one locking bar with said spring band, said one locking bar having a bottom wall containing an opening, said pin extending through said opening in said bottom.

20. A locking bar assembly for a window or door manually operated by a handle and having an inner closure frame containing a C-shaped receiving groove (3), comprising (a) a plurality of locking bars (6) slidably mounted within said receiving groove and having a U-shaped cross-sectional configuration;

(b) said locking bars including lateral leg portions (7) each containing a side groove extending the length of said bar and having a height N, said side grooves being defined between a lower web of said bar having a thickness $S_1$ and an upper web of said bar having a thickness $S_2$, said locking bars having a height $H_2$ equal to the sum of the side groove height N and the lower and upper web thickness $S_1$ and $S_2$;

(c) said frame containing edge strips (5) extending inwardly adjacent said receiving groove and having a height $H_3$ slightly less than the side groove height N;

(d) said receiving groove in said frame having a height $H_1$ greater than the height $H_2$ of said locking bars by the thickness $S_1$ of said bar upper web;

(e) said locking bars being slidably mounted within said groove in one of a first position (I) with said leg portions engaging a bottom wall of said receiving groove and a second position (II) with said leg portion side grooves receiving said frame edge strips, respectively;

(f) a first locking piece (12) connected with said locking bars when in said first position via an anchoring pin (13) arranged in a borehole of said locking bar, said first locking piece including a rectangular plate (14) containing side grooves (15) and including a locking pin (16) on a side opposite said anchoring pin; and (g) a second locking piece (19) connected with said locking bars when in said second position, said second locking piece including a rectangular plate (20) movably positioned on said receiving groove bottom wall and including a locking pin 22 extending through a borehole in the bottom of the locking bar.

* * * * *